US006888422B2

(12) United States Patent
Brown et al.

(10) Patent No.: US 6,888,422 B2
(45) Date of Patent: May 3, 2005

(54) CONTINUOUSLY VARIABLE FILTER

(75) Inventors: Stephen B. Brown, Palm Bay, FL (US); James J. Rawnick, Palm Bay, FL (US)

(73) Assignee: Harris Corporation, Melbourne, FL (US)

( * ) Notice: Subject to any disclaimer, the term of this patent is extended or adjusted under 35 U.S.C. 154(b) by 139 days.

(21) Appl. No.: 10/330,754

(22) Filed: Dec. 27, 2002

(65) Prior Publication Data

US 2004/0124948 A1 Jul. 1, 2004

(51) Int. Cl.[7] ..... H03H 7/12
(52) U.S. Cl. ..... 333/174; 333/17.3; 333/99 R
(58) Field of Search ..... 333/174, 17.1, 333/17.3, 22 F, 99 R, 178, 179

(56) References Cited

U.S. PATENT DOCUMENTS

| | | | | |
|---|---|---|---|---|
| 3,701,058 A | * 10/1972 | Smith | 333/159 |
| 5,162,972 A | * 11/1992 | Gripshover et al. | 361/277 |
| 5,389,943 A | * 2/1995 | Brommer et al. | 343/909 |
| 5,459,442 A | * 10/1995 | James | 333/156 |
| 6,515,235 B2 | 2/2003 | Moller | |
| 6,639,712 B2 | * 10/2003 | McBride et al. | 359/298 |

OTHER PUBLICATIONS

U.S. patent application Ser. No. 10/369,436, Rawnick et al., filed Feb. 18, 2003.
U.S. patent application Ser. No. 10/387,208, Rawnick et al., filed Mar. 11, 2003.
U.S. patent application Ser. No. 10/330,755, Rawnick et al., filed Dec. 27, 2002.
U.S. patent application Ser. No. 10/300,456, Rawnick et al., filed Nov. 19, 2002.
U.S. patent application Ser. No. 10/361,548, Rawnick et al., filed Feb. 10, 2003.
U.S. patent application Ser. No. 10/387,209, Rawnick et al., filed Mar. 11, 2003.
U.S. patent application Ser. No. 10/387,194, Brown et al., filed Mar. 11, 2003.
U.S. patent application Ser. No. 10/438,435, Brown et al., filed May 15, 2003.
U.S. patent application Ser. No. 10/414,696, Brown et al., filed Apr. 16, 2003.
U.S. patent application Ser. No. 10/637,027, Brown et al., filed Aug. 7, 2003.
U.S. patent application Ser. No. 10/414,650, Brown et al., filed Apr. 16, 2003.
U.S. patent application Ser. No. 10/635,629, Brown et al., filed Aug. 6, 2003.

(Continued)

*Primary Examiner*—Robert Pascal
*Assistant Examiner*—Dean Takaoka
(74) *Attorney, Agent, or Firm*—Sacco & Associates, PA

(57) ABSTRACT

A continuously variable filter (110) that includes at least one filter element (146). The filter also includes a fluidic dielectric (108) having a permittivity and a permeability, a composition processor (101) adapted for dynamically changing a composition of the fluidic dielectric (108), and a controller (136) for controlling the composition processor (101) to selectively vary the permittivity and/or the permeability in response to a filter control signal (137). The filter element (146) is at least partially coupled to the fluidic dielectric (108). A second fluidic dielectric having a different composition than the first fluidic dielectric can be provided and a second filter element (148) can be partially coupled to the second fluidic dielectric. The controller (136) and composition processor (101) also can be adapted for varying the permittivity and/or permeabiliity of the fluidic dielectric (108).

48 Claims, 4 Drawing Sheets

OTHER PUBLICATIONS

U.S. patent application Ser. No. 10/459,067, Brown et al., filed Jun. 11, 2003.
U.S. patent application Ser. No. 10/438,436, Rawnick et al., filed May 15, 2003.
U.S. patent application Ser. No. 10/626,090, Brown et al., filed Jul. 24, 2003.
U.S. patent application Ser. No. 10/635,582, Rawnick et al., filed Aug. 6, 2003.
U.S. patent application Ser. No. 10/632,632, Rawnick et al., filed Aug. 1, 2003.
U.S. patent application Ser. No. 10/614,149, Brown et al., filed Jul. 7, 2003.
U.S. patent application Ser. No. 10/634,219, Rawnick et al., filed Aug. 5, 2003.
U.S. patent application Ser. No. 10/458,859, Rawnick et al., filed Jun. 11, 2003.
U.S. patent application Ser. No. 10/624,378, Brown et al., filed Jul. 22, 2003.
U.S. patent application Ser. No. 10/438,433, Rawnick et al., filed May 15, 2003.
U.S. patent application Ser. No. 10/460,947, Rawnick et al., filed Jun. 13, 2003.
U.S. patent application Ser. No. 10/421,352, Rawnick et al., filed Apr. 23, 2003.
U.S. patent application Ser. No. 10/409,261, Pike, filed Apr. 8, 2003.
U.S. patent application Ser. No. 10/441,743, Pike, filed May 19, 2003.
U.S. patent application Ser. No. 10/628,846, Pike et al., filed Jul. 28, 2003.
U.S. patent application Ser. No. 10/300,455, Brown et al., filed Nov. 19, 2002.

* cited by examiner

CONTINUOUSLY VARIABLE FILTER

BACKGROUND OF THE INVENTION

1. Statement of the Technical Field

The inventive arrangements relate generally to methods and apparatus for providing increased design flexibility for RF circuits, and more particularly to variable microstrip, buried microstrip and stripline filters.

2. Description of the Related Art

A filter is a frequency-selective signal transmission device in which certain ranges of frequencies (the passband) are passed from an input to an output, while other ranges (the stopband) are rejected. Filters can be formed in many different ways. For example, one configuration, known as microstrip, places conductive traces (filter elements) on a board (substrate) surface and provides a second conductive layer, commonly referred to as a ground plane. Microstrip filter elements are each designed to have a specific impedance and/or signal response, which are determined by the trace geometry and the dielectric properties of the substrate material. Further, the conductive traces are arranged on the substrate in accordance with a selected filter topology. A second configuration, known as buried microstrip, is similar to microstrip except that the filter elements are covered with a dielectric substrate material. In a third configuration, known as stripline, the filter elements sandwiched within substrate between two electrically conductive (ground) planes. In all cases, the characteristics of the filter are determined in part by the electrical properties of the material (e.g. substrate) in which the conductive elements of the filter are embedded.

Two critical factors affecting the performance of a substrate material are permittivity (sometimes called the relative permittivity or $\in_r$) and permeability (sometimes referred to as relative permeability or $\mu_r$). The relative permittivity and permeability determine the propagation velocity of a signal, which is approximately inversely proportional to $\sqrt{\mu\in}$, and therefore affect the electrical length of a filter element. Further, ignoring loss, the characteristic impedance of a filter element, such as stripline or microstrip, is equal to $\sqrt{L_l/C_l}$ where $L_l$ is the inductance per unit length and $C_l$ is the capacitance per unit length. The values of $L_l$ and $C_l$ are generally determined by the permittivity and the permeability of the dielectric material(s) used to separate the filter elements from other transmission line structures as well as the physical geometry and spacing of the filter elements and transmission line structures.

In a conventional RF design, a substrate-material is selected that has a relative permittivity value suitable for the design. Notably, conventional substrate materials typically have a relative permeability of approximately 1.0. Once the substrate material is selected, the filter response is exclusively adjusted by controlling the topology of the filter and the geometry and physical structure of the filter elements.

One problem encountered when designing such filters is that the filters are generally optimized only for a predetermined passband and stopband at a pre-determined impedance. If the filter is designed to have a wide passband to pass multiple signals at different frequencies, a greater amount of noise and undesired signals that happen to be in the filter's passband also will be propagated through the filter. On the other hand, if the filter is designed to have a narrow passband which limits the amount of noise and undesired signals that pass through the filter, only a limited range of desired signals will then be able pass through the filter. Modern RF circuits, however, commonly process multiple signals operating on different frequencies. An approach to address this dilemma is to make frequency selective properties of the filter variable. State of the art approaches to making the frequency selective properties variable generally include the use of mechanical means to alter the arrangement of the conducting elements of the filter, introducing a nonlinear component, such as a variactor, or digitizing the signal and implementing the frequency selection by numerical processing. Some approaches also vary the position or size of a dielectric component, for example a ferromagnetic inductor core whose position relative to inductor coil windings is varied by a screw mechanism, or a piezo-crystal whose dimension is varied in the presence of an electric field. However, such approaches provide only a limited range of adjustment for the frequency selective properties of the filter.

SUMMARY OF THE INVENTION

The present invention relates to a continuously variable filter that includes at least one filter element. The filter also includes a fluid dielectric having a permittivity and a permeability, a composition processor adapted for dynamically changing a composition of the fluidic dielectric, and a controller for controlling the composition processor to selectively vary the permittivity and/or permeability in response to a filter control signal. The filter element is at least partially coupled to the fluidic dielectric. Further, a second fluidic dielectric having a different composition than the first fluidic dielectric can be provided and a second filter element can be partially coupled to the second fluidic dielectric. The permeability can be varied to maintain the characteristic impedance approximately constant when the permittivity is varied or to adjust the characteristic impedance when the permittivity is maintained approximately constant. Also, the permittivity can be varied to maintain the characteristic impedance approximately constant when the permeability is varied or to adjust the characteristic impedance when the permeability is maintained approximately constant.

The filter element also can be coupled to a solid dielectric substrate material, for example a substrate formed from a ceramic material, such as low temperature co-fired ceramic material.

A plurality of component parts can be dynamically mixed together in the composition processor responsive to the control signal to form the fluidic dielectric. The component parts can consist of a low permittivity, low permeability component, a high permittivity, low permeability component, and a high permittivity, high permeability component. The composition processor can include at least one proportional valve, at least one mixing pump, and at least one conduit for selectively mixing and communicating a plurality of the components of the fluidic dielectric from respective fluid reservoirs to a cavity coupled to the filter element. The composition processor also can include a component part separator adapted for separating the component parts of the fluidic dielectric for subsequent reuse. In one arrangement, the fluidic dielectric can be comprised of an industrial solvent that has a suspension of magnetic particles contained therein consisting of ferrite, metallic salts, or organo-metallic particles, containing between about 50% to 90% magnetic particles by weight.

DETAILED DESCRIPTION OF THE PREFERRED EMBODIMENTS

The present invention provides the circuit designer with an added level of flexibility by permitting a fluidic dielectric to be used in an RF circuit, thereby enabling the dielectric properties proximate to a microstrip, a buried microstrip, and a stripline filter (herein after collectively referred to as filter) to be varied so that a particular filter can be used over a broad frequency range. Since propagation velocity is inversely proportional to $\sqrt{\mu\in}$, increasing the permeability ($\mu$) and/or permittivity ($\in$) in the dielectric decreases propagation velocity of a signal on filter elements coupled to the dielectric, and thus the signal wavelength. Further, the permittivity and/or permeability can be chosen to result in desired impedances (Z) for the filter elements as well. Accordingly, a filter of a given size can be used over a broad range of frequencies and for different circuit impedances without altering the physical dimensions of the filter.

Figure 1:
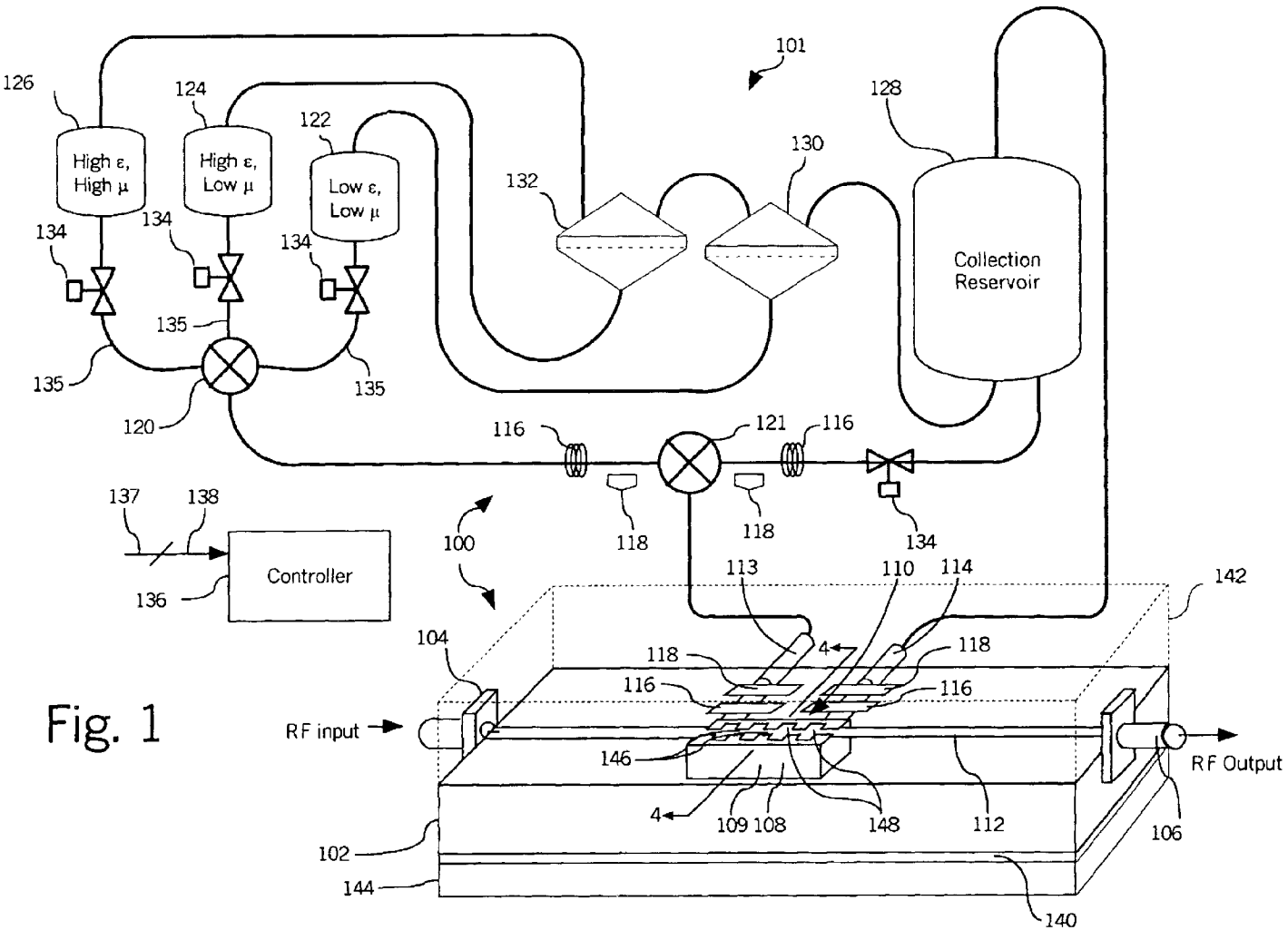
FIG. 1 is a block diagram useful for understanding the variable filter of the invention.

FIG. 1 is a conceptual diagram that is useful for understanding the continuously variable filter of the present invention. The filter apparatus 100 includes a filter 110 comprising filter elements 146 and 148 at least partially coupled to a fluidic dielectric 108. The filter elements 146 and 148 can have a pre-determined geometry, a characteristic impedance, and can be suspended over a ground plane 140, but the invention is not so limited. Further, the filter 110 can be a low pass filter, a band pass filter, a high pass filter, a band notch filter, a comb filter or any other type of filter that can be implemented on a substrate. Moreover, the filter topology can be any filter topology, for example, a stepped impedance filter, a constant impedance filter, a half-wave filter, a coupled resonator filter, a coupled line filter, a hairpin bandpass filter, and so on. For example, each filter element can be designed to have a specific characteristic impedance ($Z_0$) or input impedance ($Z_{in}$), which can vary from one element to the next. In another arrangement, filter elements can be adjacently positioned so that portions of the elements can be capacitively coupled. Further, resonant lines, which are well known to the skilled artisan, can be used as filter elements, for example to provide elements with inductive or capacitive impedances. Still, other filter structures can be used and will be understood to be included in the present invention.

The fluidic dielectric 108 is constrained within a cavity region 109 that is generally positioned relative to the filter elements 146 and 148 so as to be electrically and magnetically coupled thereto. A composition processor 101 is provided for changing a composition of the fluidic dielectric 108 to vary its permittivity and/or permeability. A controller 136 controls the composition processor for selectively varying the permittivity and/or permeability of the fluidic dielectric 108 in response to a filter control signal 137. By selectively varying the permittivity and/or permeability of the fluidic dielectric, the controller 136 can control propagation velocity of an RF signal along the filter elements 146 and 148, and thus the signal wavelength. Further, the controller 136 can control the impedance of the filter elements 146 and 148 as well. These characteristics can be used to selectively tune the filter 110 to optimize the filter 110 for a predetermined operational frequency and impedance as established by the filter control signal 137.

For example, the permittivity and/or permeability of the fluidic dielectric can be adjusted to vary the capacitance between at least one of the filter elements 146 and 148 and the ground plane 140, or the inductance of the filter elements 146 and 148. These capacitance and inductance adjustments can be used to tune the filter for operation at selected frequencies. For example, adjustments can be made to the filter passband, stopband, center frequency, bandwidth, quality factor (Q), characteristic impedance, or any other filter parameter that can be adjusted by a change in permittivity and/or permeability. Capacitance and inductance values also can be adjusted to produce a desired filter response.

In a further example, a filter element can comprise a resonant line, which typically has an electrical length that is some multiple of a quarter-wavelength of a selected frequency. The input impedance to a typical resonant line is resistive when the length of the resonant line is an even or odd multiple of the quarter-wavelength of the operational frequency, that is, the length of the resonant line corresponds to a location of a voltage minima or maxima on the resonant line. The input impedance to the resonant line has reactive components when the input to the resonant line is located between positions of voltage minima or maxima. Notably, the permittivity and/or permeability of the fluidic dielectric 108 can be varied to change the wavelength of a signal on the resonant line so that a particular multiple of the signal quarter-wavelength correlates to the length of the resonant line. Accordingly, impedance characteristics of the resonant line can be maintained constant as the frequency changes. Further, the permittivity and/or permeability of the fluidic dielectric 108 can be adjusted to vary the signal wavelength so that the positions of relative voltage minima and maxima on the resonant line are adjusted. Accordingly, the input impedance of the resonant line can be varied to produce a desired filter response or to change a characteristic impedance of the filter.

Composition of Fluidic Dielectric

The fluidic dielectric can be comprised of several component parts that can be mixed together to produce a desired permeability and permittivity required for a particular time propagation velocity and transmission line characteristic impedance. In this regard, it will be readily appreciated that fluid miscibility and particle suspension are key considerations to ensure proper mixing. Another key consideration is the relative ease by which the component parts can be subsequently separated from one another. The ability to separate the component parts is important when the passband or impedance requirements change. Specifically, this feature ensures that the component parts can be subsequently re-mixed in a different proportion to form a new fluidic dielectric.

The resultant mixture comprising the fluidic dielectric also preferably has a relatively low loss tangent to minimize the amount of RF energy lost in the filter. However, devices with higher insertion loss may be acceptable in some instances so this may not be a critical factor. Many applications also require filters to be tunable over a wide frequency range. Accordingly, it may be desirable in many instances to select component mixtures that produce a fluidic dielectric that has a relatively constant response over a broad range of frequencies. If the fluidic dielectric is not relatively constant over a broad range of frequencies, the characteristics of the fluid at various frequencies can be accounted for when the fluidic dielectric is mixed. For example, a table of permittivity and permeability values vs. frequency can be stored in the controller 136 for reference during the mixing process.

Aside from the foregoing constraints, there are relatively few limits on the range of component parts that can be used to form the fluidic dielectric. Accordingly, those skilled in the art will recognize that the examples of component parts, mixing methods and separation methods as shall be disclosed herein are merely by way of example and are not intended to limit in any way the scope of the invention. Also, the component materials are described herein as being mixed in order to produce the fluidic dielectric. However, it should be noted that the invention is not so limited. Instead, it should be recognized that the composition of the fluidic dielectric could be modified in other ways. For example, the component parts could be selected to chemically react with one another in such a way as to produce the fluidic dielectric with the desired values of permittivity and/or permeability. All such techniques will be understood to be included to the extent that it is stated that the composition of the fluidic dielectric is changed.

A nominal value of permittivity ($\in_r$) for fluids is approximately 2.0. However, the component parts for the fluidic dielectric can include fluids with extreme values of permittivity. Consequently, a mixture of such component parts can be used to produce a wide range of intermediate permittivity values. For example, component fluids could be selected with permittivity values of approximately 2.0 and about 58 to produce a fluidic dielectric with a permittivity anywhere within that range after mixing. Dielectric particle suspensions can also be used to increase permittivity.

According to a preferred embodiment, the component parts of the fluidic dielectric can be selected to include a low permittivity, low permeability component and a high permittivity, high permeability component. These two components can be mixed as needed for increasing permittivity while maintaining a relatively constant ratio of permittivity to permeability. A third component part of the fluidic dielectric can include a high permittivity, low permeability component for allowing adjustment of the permittivity of the fluidic dielectric independent of the permeability.

High levels of magnetic permeability are commonly observed in magnetic metals such as Fe and Co. For example, solid alloys of these materials can exhibit levels of $\mu_r$ in excess of one thousand. By comparison, the permeability of fluids is nominally about 1.0 and they generally do not exhibit high levels of permeability. However, high permeability can be achieved in a fluid by introducing metal particles/elements to the fluid. For example typical magnetic fluids comprise suspensions of ferro-magnetic particles in a conventional industrial solvent such as water, toluene, mineral oil, silicone, and so on. Other types of magnetic particles include metallic salts, organo-metallic compounds, and other derivatives; although Fe and Co particles are most common. The size of the magnetic particles found in such systems is known to vary to some extent. However, particles sizes in the range of 1 nm to 20 $\mu$m are common. The composition of particles can be varied as necessary to achieve the required range of permeability in the final mixed fluidic dielectric after mixing. However, magnetic fluid compositions are typically between about 50% to 90% particles by weight. Increasing the number of particles will generally increase the permeability.

An example of a set of component parts that could be used to produce a fluidic dielectric as described herein would include oil (low permittivity, low permeability), a solvent (high permittivity, low permeability) and a magnetic fluid, such as combination of an oil and a ferrite (low permittivity and high permeability). A hydrocarbon dielectric oil such as Vacuum Pump Oil MSDS-12602 could be used to realize a low permittivity, low permeability, and low electrical loss fluid. A low permittivity, high permeability fluid may be realized by mixing the hydrocarbon fluid with magnetic particles or metal powders which are designed for use in ferrofluids and magnetoresrictive (MR) fluids. For example magnetite magnetic particles can be used. Magnetite is commercially available from FerroTec Corporation of Nashua, N.H. 03060. An exemplary metal powder that can be used is iron-nickel, which can be provided by Lord Corporation of Cary, N.C. Fluids containing electrically conductive magnetic particles require a mix ratio low enough to ensure that no electrical path can be created in the mixture. Additional ingredients such as surfactants can be included to promote uniform dispersion of the particles. High permittivity can be achieved by incorporating solvents such as formamide, which inherently posses a relatively high permittivity. Fluid Permittivity also can be increased by adding high permittivity powders such as Barium Titanate manufactured by Ferro Corporation of Cleveland, Ohio. For broadband applications, the fluids would not have significant resonances over the frequency band of interest.

Processing of Fluidic Dielectric for Mixing/Unmixing of Components

The composition processor 101 can be comprised of a plurality of fluid reservoirs containing component parts of fluidic dielectric 108. These can include a first fluid reservoir 122 for a low permittivity, low permeability component of the fluidic dielectric, a second fluid reservoir 124 for a high permittivity, low permeability component of the fluidic dielectric, and a third fluid reservoir 126 for a high permittivity, high permeability component of the fluidic dielectric. Those skilled in the art will appreciate that other combinations of component parts may also be suitable and the invention is not intended to be limited to the specific combination of component parts described herein.

A cooperating set of proportional valves 134, mixing pumps 120, 121, and connecting conduits 135 can be provided as shown in FIG. 1 for selectively mixing and communicating the components of the fluidic dielectric 108 from the fluid reservoirs 122, 124, 126 to cavity 109. The composition processor also serves to separate out the component parts of fluidic dielectric 108 so that they can be subsequently re-used to form the fluidic dielectric with different permittivity and/or permeability values. All of the various operating functions of the composition processor can be controlled by controller 136. The operation of the composition processor shall now be described in greater detail with reference to FIG. 1 and the flowchart shown in FIG. 2.

Figure 2:
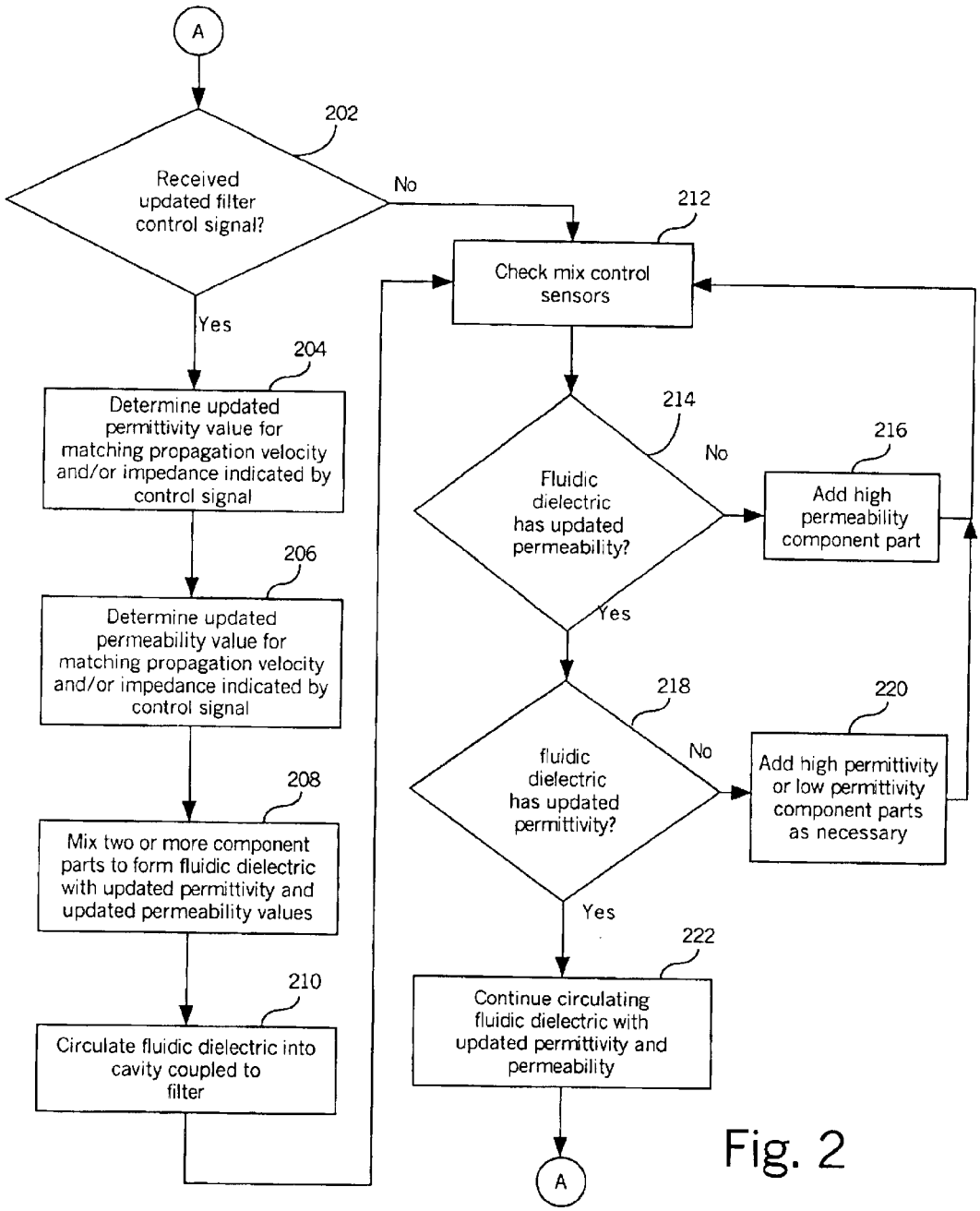
FIG. 2 is a flow chart that is useful for understanding the process of the invention.

The process can begin in step 202 of FIG. 2, with controller 136 checking to see if an updated filter control signal 137 has been received on a filter control signal input line 138. If so, then the controller 136 continues on to step 204 to determine an updated permittivity value for producing the propagation velocity or characteristic impedance indicated by the filter control signal 137. The updated permittivity value necessary for achieving the indicated propagation velocity or characteristic impedance can be determined using a look-up table.

In step 206, the controller can determine an updated permeability value required for maintaining a constant characteristic impedance of filter 110. In step 208, the controller 136 causes the composition processor 101 to begin mixing two or more component parts in a proportion to form fluidic dielectric that has the updated permittivity and permeability values determined earlier. This mixing process can be accomplished by any suitable means. For example, in FIG. 1 a set of proportional valves 134 and mixing pump 120 are used to mix component parts from reservoirs 122, 124, 126 appropriate to achieve the desired updated permeability and permittivity.

In step 210, the controller causes the newly mixed fluidic dielectric 108 to be circulated into the cavity 109 through a second mixing pump 121. In step 212, the controller checks one or more sensors 116, 118 to determine if the fluidic dielectric being circulated through the cavity 109 has the proper values of permeability and permittivity. Sensors 116 are preferably inductive type sensors capable of measuring permeability. Sensors 118 are preferably capacitive type sensors capable of measuring permittivity. The sensors can be located as shown, at the input to mixing pump 121. Sensors 116, 118 are also preferably positioned within solid dielectric substrate 102 to measure the permeability and permittivity of the fluidic dielectric passing through input conduit 113 and output conduit 114. Note that it is desirable to have a second set of sensors 116, 118 at or near the cavity 109 so that the controller can determine when the fluidic dielectric with updated permittivity and permeability values has completely replaced any previously used fluidic dielectric that may have been present in the cavity 109.

In step 214, the controller 136 compares the measured permeability to the desired updated permeability value determined in step 206. If the fluidic dielectric does not have the proper updated permeability value, the controller 136 can cause additional amounts of high permeability component part to be added to the mix from reservoir 126, as shown in step 216.

If the fluidic dielectric is determined to have the proper level of permeability in step 214, then the process continues on to step 218 where the measured permittivity value from step 212 is compared to the desired updated permittivity value from step 204. If the updated permittivity value has not been achieved, then high or low permittivity component parts are added as necessary in step 220. If both the permittivity and permeability passing into and out of the cavity 109 are the proper value, the system can stop circulating the fluidic dielectric and the system returns to step 202 to wait for the next updated filter control signal.

Significantly, when updated fluidic dielectric is required, any existing fluidic dielectric must be circulated out of the cavity 109. Any existing fluidic dielectric not having the proper permeability and/or permittivity can be deposited in a collection reservoir 128. The fluidic dielectric deposited in the collection reservoir can thereafter be re-used directly as a fourth fluid by mixing with the first, second, and third fluids or separated out into its component parts in separator units 130, 132 so that it may be re-used at a later time to produce additional fluidic dielectric. The aforementioned approach includes a method for sensing the properties of the collected fluid mixture to allow the fluid processor to appropriately mix the desired composition, and thereby, allowing a reduced volume of separation processing to be required. For example the component parts can be selected to include a first fluid made of a high permittivity solvent completely miscible with a second fluid made of a low permittivity oil that has a significantly different boiling point. A third fluid component can be comprised a ferrite particle suspension in a low permittivity oil identical to the first fluid such that the first and second fluids do not form azeotropes. Given the foregoing, the following process may be used to separate the component parts.

A first stage separation process in separator unit 130 would utilize distillation to selectively remove the first fluid from the mixture by the controlled application of heat thereby evaporating the first fluid, transporting the gas phase to a physically separate condensing surface whose temperature is maintained below the boiling point of the first fluid, and collecting the liquid condensate for transfer to the first fluid reservoir 122. A second stage process in separator unit 132 would introduce the mixture, free of the first fluid, into a chamber that includes an electromagnet that can be selectively energized to attract and hold the paramagnetic particles while allowing the pure second fluid to pass which is then diverted to the second fluid reservoir 124. Upon de-energizing the electromagnet, the third fluid would be recovered by allowing the previously trapped magnetic particles to combine with the fluid exiting the first stage which is then diverted to the third fluid reservoir 126.

Those skilled in the art will recognize that the specific process used to separate the component parts from one another will depend largely upon the properties of materials that are selected and the invention. Accordingly, the invention is not intended to be limited to the particular process outlined above.

Multiple Cavity Regions

In addition to the filter structure shown in FIG. 1 wherein a single cavity region 109 is provided for the dielectric fluid 108, other arrangements can be implemented wherein multiple cavities are provided proximate to different portions of the filter. The composition of the dielectric fluid in each cavity can be individually adjusted to tune filter parameters. This feature can be very useful during system development as it allows filter parameters in a prototype to be quickly and easily changed, thereby saving time and expense associated with fabricating a new filter each time an engineer wishes to fine tune filter parameters. For example, impedances of individual filter elements can be finely tuned to adjust a filter cutoff frequency or a characteristic impedance of a filter. Further, the elements of the filter can be tuned to provide a different filter transfer function. For example, the topology of a filter can be changed from a Butterworth topology to a Bessel topology.

Figure 3:
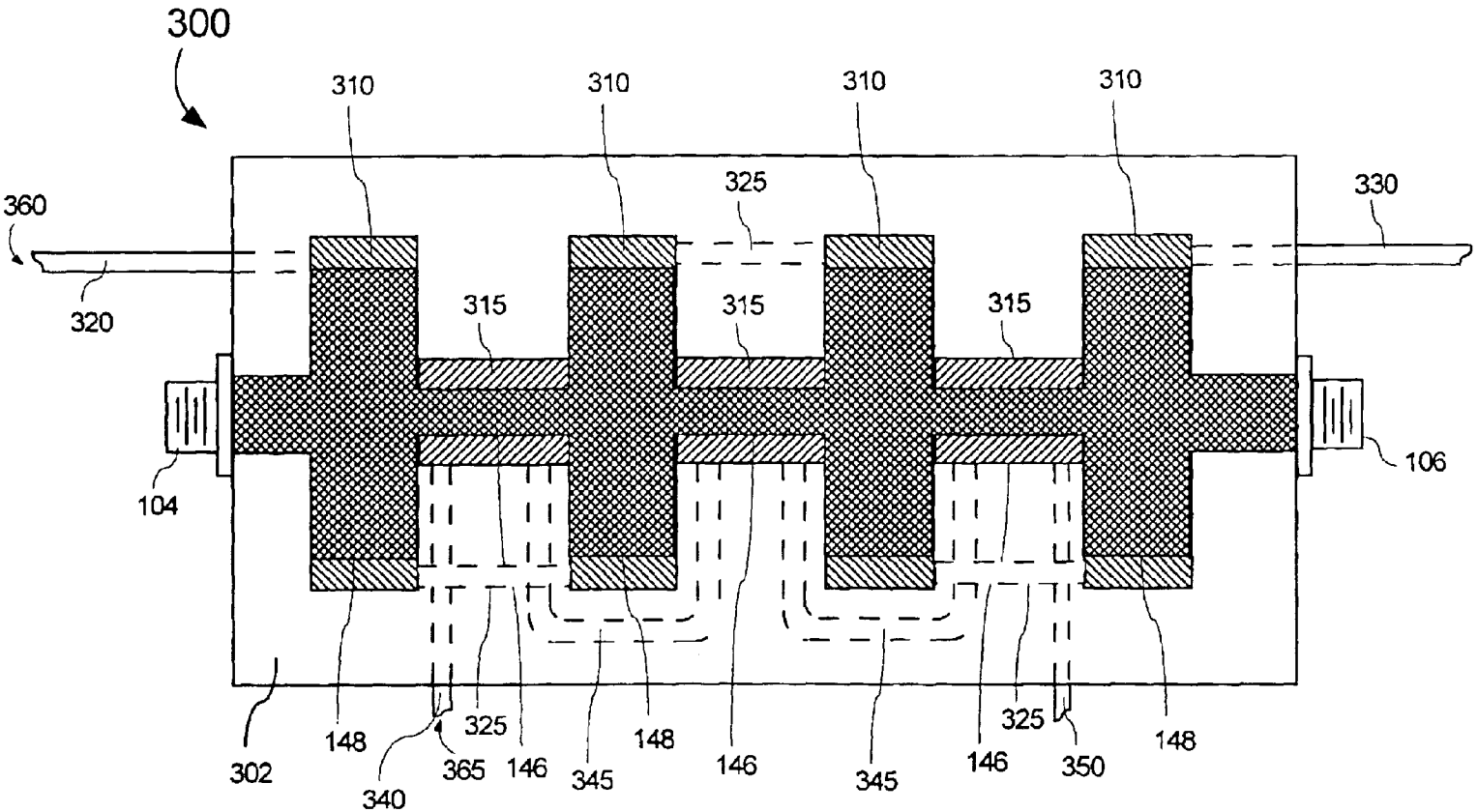
FIG. 3 is a top view of an alternate arrangement of the variable filter of the invention.

Further, in filters having multiple sections that require similar dielectric parameters, the cavity regions proximate to those filter sections can be coupled to share a same composition of dielectric fluid, as shown in FIG. 3. The figure shows a top view an exemplary filter 300 comprising low impedance filter elements 148 coupled to low impedance cavity regions 310 and high impedance filter elements 146 coupled to high impedance cavity regions 315. The cavity regions 310 and 315 can be contained within a dielectric substrate 302 and preferably extend completely beneath the respective filter elements 146 and 148. In an arrangement where desired characteristics for the low impedance filter elements 148 and the high impedance filter elements 146 are such that the filter elements 148 and 146 require different fluidic dielectric compositions, the low impedance cavity regions 310 and high impedance cavity regions 315 can be provided with different dielectric fluid compositions. For example, low impedance cavity regions 310 can be fluidically coupled together via conduits 325 and high impedance cavity regions 315 also can be fludically coupled together via conduits 345. Further, the low impedance cavity regions 310 can be coupled to the composition processor 101 with a first set of input and output conduits 320 and 330, and the high impedance cavity regions 315 can be coupled to the composition processor 101 with a second set of input and output conduits, 340 and 350.

Notably, a second set of proportional valves, mixing pumps and sensors (collectively referred to as a mixing apparatus) can be provided. Hence, a first mixing apparatus can mix a first fluidic dielectric composition 360 for the low impedance cavity regions 310 and a second mixing apparatus can mix a second fluidic dielectric composition 365 for the high impedance cavity regions 315. In the case that both the first and second fluidic dielectric compositions 360 and 365 comprise the same components, although perhaps in different ratios, a single collection reservoir 128 can be provided. Further, a single set of fluid reservoirs 122, 124 and 126, and fluid separators 130 and 132 can be provided. Alternatively, a complete composition processor can be provided for each set of cavity regions 310 and 315. It should be noted that although the example herein is presented with two sets of cavity regions, the invention is not so limited and any number of cavity regions being filled with different fluidic dielectric compositions can be provided.

RF Unit Structure, Materials and Fabrication

In theory, constant characteristic impedance can be obtained for a filter element by maintaining a constant ratio of permittivity to permeability in the dielectric to which the line is coupled. Accordingly, in those instances where the transmission line is for all practical purposes coupled exclusively to the fluidic dielectric, then it is merely necessary to maintain a constant ratio of $\in_r/\mu_r$, where $\in_r$ is the permittivity of the fluidic dielectric, and $\mu_r$ is the permeability of the fluidic dielectric. A cross-sectional view of such a line is illustrated in FIG. 4*a*.

Figure 4A:
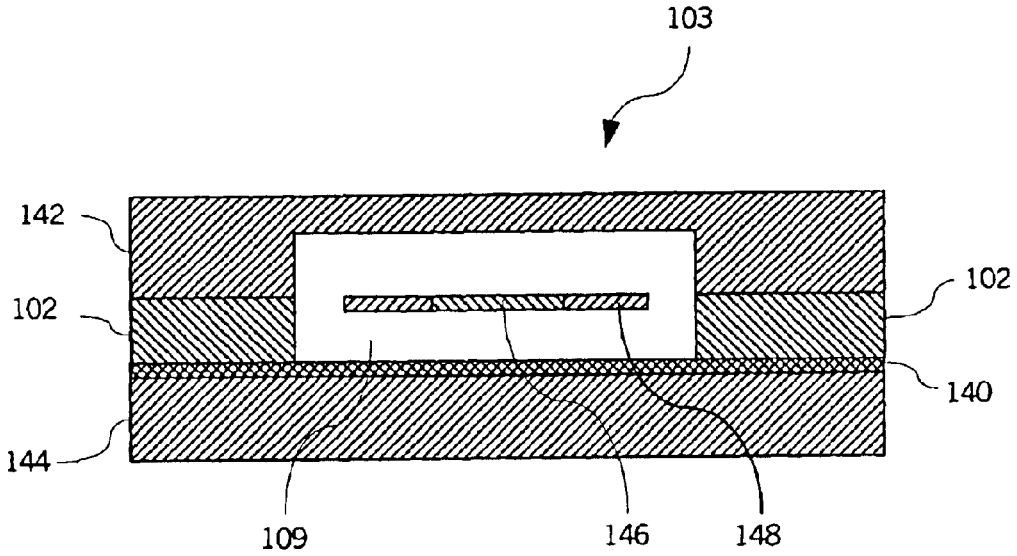
FIG. 4*a* is a cross-sectional view of the filter structure in FIG. 1, taken along line 4—4.

FIG. 4*a* is a cross-sectional view of one embodiment of the filter elements in FIG. 1, taken along line 4—4, that is useful for understanding the invention. As illustrated therein, cavity 109 can be formed in substrate 102 and continued in cap substrate 142 so that the fluidic dielectric is closely coupled to filter elements 146 and 148 on all sides of the filter elements 146 and 148. The filter elements 146 and 148 are suspended within the cavity 109 as shown. A ground plane 140 is disposed below the filter elements 146 and 148 between substrate 102 and base substrate 144.

Figure 4B:
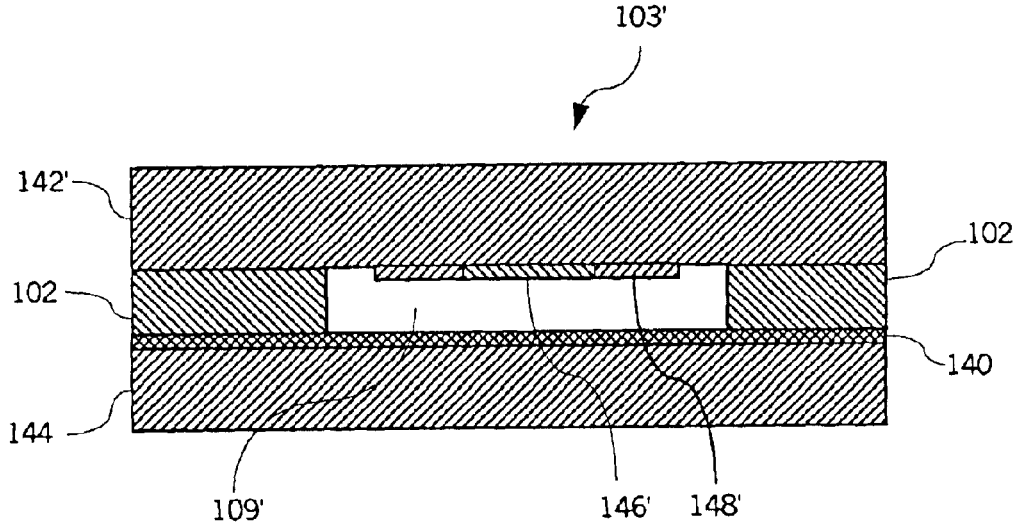
FIG. 4*b* is a cross-sectional view of an alternative embodiment of a filter structure of FIG. 1.

FIG. 4*b* is a cross-sectional view showing an alternative arrangement for the filter elements 146' and 148' in which the cavity structure 109' extends on only one side of the filter elements 146' and 148' and the filter elements 146' and 148' are partially coupled to the solid dielectric substrate 142'. In the case where the transmission line is also partially coupled to a solid dielectric, the permeability $\mu_r$ necessary to keep the characteristic impedance of the line constant can be expressed as follows:

$$\mu_r=\mu_{r,sub}(\in_r/\in_{r,sub})$$

where $\mu_{r,sub}$ is the permeability of the solid dielectric substrate 142, $\in_r$ is the permittivity of the fluidic dielectric 108 and $\in_{r,sub}$ is the permittivity of the solid dielectric substrate 142.

The impedance of a transmission line is not independent of the transmission line structure. However, it is always proportional to the square root of the ratio of the permeability to the permittivity of the media in which the conducting structures are embedded. Thus, for any transmission line, such as the filter elements 146 and 148, if both the permeability and permittivity are changed in the same proportion, and no other changes are made, the impedance will remain constant. The equation specified enforces the condition of a constant ratio of $\mu_r$ to $\in_r$ and thus ensure constant impedance for all transmission line structures.

At this point it should be noted that while the embodiment of the invention in FIG. 1 is shown essentially in the form of a buried microstrip construction, the invention herein is not intended to be so limited. Instead, the invention can be implemented using any type of transmission line by replacing at least a portion of a conventional solid dielectric material that is normally coupled to the transmission line with a fluidic dielectric as described herein. For example, and without limitation, the invention can be implemented in transmission line configurations including conventional waveguides, stripline, microstrip, coaxial lines, and embedded coplanar waveguides. All such structures are intended to be within the scope of the invention.

According to one aspect of the invention, the solid dielectric substrate 102, 144, 142 can be formed from a ceramic material. For example, the solid dielectric substrate can be formed from a low temperature co-fired ceramic (LTCC). Processing and fabrication of RF circuits on LTCC is well known to those skilled in the art. LTCC is particularly well suited for the present application because of its compatibility and resistance to attack from a wide range of fluids. The material also has superior properties of wetability and absorption as compared to other types of solid dielectric material. These factors, plus LTCC's proven suitability for manufacturing miniaturized RF circuits, make it a natural choice for use in the present invention.

We claim:

1. A continuously variable filter, comprising:

at least one fluidic dielectric having a permittivity and a permeability;

at least one composition processor adapted for dynamically changing a composition of said fluidic dielectric to vary at least one of said permittivity and said permeability;

at least one filter element partially coupled to said fluidic dielectric; and a controller for controlling said composition processor to selectively vary at least one of said permittivity and said permeability in response to a filter control signal.

2. The variable filter according to claim 1 wherein said controller causes said composition processor to selectively vary said permittivity and said permeability concurrently in response to said filter control signal.

3. The variable filter according to claim 1 wherein said permittivity and said permeability are varied to adjust at least one of a passband, a stopband, a center frequency, a bandwidth, a quality factor (Q) and a characteristic impedance.

4. The variable filter according to claim 1 wherein said filter element has a characteristic impedance and said controller causes said composition processor to selectively vary said permeability to maintain said characteristic impedance approximately constant when said permittivity is varied.

5. The variable filter according to claim 1 wherein said filter element has a characteristic impedance and said controller causes said composition processor to selectively vary said permeability to adjust said characteristic impedance when said permittivity is maintained approximately constant.

6. The variable filter according to claim 1 wherein said filter element has a characteristic impedance and said controller causes said composition processor to selectively vary said permittivity to maintain said characteristic impedance approximately constant when said permeability is varied.

7. The variable filter according to claim 1 wherein said filter element has a characteristic impedance and said controller causes said composition processor to selectively vary said permittivity to adjust said characteristic impedance when said permeability is maintained approximately constant.

8. The variable filter according to claim 1 wherein said filter element is also coupled to a solid dielectric substrate material.

9. The variable filter according to claim 8 wherein said permeability is varied to be approximately equal to $\mu_{r,sub}$ $(\in_r/\in_{r,sub})$ where $\mu_{r,sub}$ is the permeability of the solid dielectric substrate, $\in_r$ is the permittivity of the fluidic dielectric and $\in_{r,sub}$ is the permittivity of the solid dielectric substrate.

10. The variable filter according to claim 8 wherein said solid dielectric substrate is formed from a ceramic material.

11. The variable filter according to claim 8 wherein said solid dielectric substrate is formed from a low temperature co-fired ceramic.

12. The variable filter according to claim 1 wherein a plurality of component parts are dynamically mixed together in said composition processor responsive to said filter control signal to form said fluidic dielectric.

13. The variable filter according to claim 12 wherein said component parts are selected from the group consisting of a low permittivity, low permeability component, a high permittivity, low permeability component, and a high permittivity, high permeability component.

14. The variable filter according to claim 12 wherein said composition processor further comprises at least one proportional valve, at least one mixing pump, and at least one conduit for selectively mixing and communicating a plurality of said components of said fluidic dielectric from respective fluid reservoirs to a cavity coupled to said filter element.

15. The variable filter according to claim 12 wherein said composition processor further comprises a component part separator adapted for separating said component parts of said fluidic dielectric for subsequent reuse.

16. The variable filter according to claim 1 wherein said fluidic dielectric is comprised of an industrial solvent.

17. The variable filter according to claim 16 wherein said industrial solvent has a suspension of magnetic particles contained therein.

18. The variable filter according to claim 17 wherein said magnetic particles are formed of a material selected from the group consisting of ferrite, metallic salts, and organometallic particles.

19. The variable filter according to claim 17 wherein said component contains between about 50% to 90% magnetic particles by weight.

20. The variable filter according to claim 1 further comprising a plurality of said filter elements.

21. The variable filter according to claim 20 further comprising a second fluidic dielectric having a different composition than a first one of said fluidic dielectric, wherein a first one of said filter elements is at least partially coupled to said first fluidic dielectric and a second one of said filter elements is at least partially coupled to said second fluidic dielectric.

22. The variable filter according 21 wherein at least one of said permittivity and said permeability of said first fluidic dielectric is adjusted independently of a permittivity and a permeability of said second fluidic dielectric.

23. The variable filter according to claim 22 wherein said adjustment of said permittivity and said permeability of said first dielectric changes an impedance of said first filter element.

24. The variable filter according to claim 21 further comprising a plurality of said composition processors.

25. A method for filtering an RF signal comprising the steps of:

propagating said RF signal along at least one filter element coupled to a fluidic dielectric; and dynamically changing a composition of said fluidic dielectric to selectively vary at least one of a permittivity and a permeability of said fluidic dielectric in response to a filter control signal.

26. The method according to claim 25 further comprising the step of selectively varying said permittivity and said permeability concurrently in response to said filter control signal.

27. The method according to claim 25 further comprising the step of selectively varying said permittivity and said permeability to adjust at least one of a passband, a stopband, a center frequency, a bandwidth, a quality factor (Q) and a characteristic impedance.

28. The method according to claim 25 further comprising the step of selectively varying said permeability to maintain a characteristic impedance of said filter element approximately constant when said permittivity is varied.

29. The method according to claim 25 further comprising the step of selectively varying said permeability to adjust said characteristic impedance when said permittivity is maintained approximately constant.

30. The method according to claim 25 further comprising the step of selectively varying said permittivity to maintain said characteristic impedance approximately constant when said permeability is varied.

31. The method according to claim 25 further comprising the step of selectively varying said permittivity to adjust said characteristic impedance when said permeability is maintained approximately constant.

32. The method according to claim 25 further comprising the step of coupling said filter element to a solid dielectric substrate material.

33. The method according to claim 32 further comprising the step of varying said permeability to be approximately equal to $\mu_{r,sub}(\in_r/\in_{r,sub})$ where $\mu_{r,sub}$ is the permeability of the solid dielectric substrate, $\in_r$ is the permittivity of the fluidic dielectric and $\in_{r,sub}$ is the permittivity of the solid dielectric substrate.

34. The method according to claim 32 further comprising the step of forming said solid dielectric substrate from a ceramic material.

35. The method according to claim 32 further comprising the step of forming said solid dielectric substrate from a low temperature co-fired ceramic.

36. The method according to claim 25 further comprising the step of dynamically mixing a plurality of components in response to said filter control signal to produce said fluidic dielectric.

37. The method according to claim 36 wherein said components are selected from the group consisting of a low permittivity, low permeability component, a high permittivity, low permeability component, and a high permittivity, high permeability component.

38. The method according to claim 36 further comprising the step of separating said components into said component parts for subsequent reuse in forming said fluidic dielectric.

39. The method according to claim 25 further comprising the step of communicating said fluidic dielectric to a cavity adjacent to said filter element.

40. The method according to claim 25 further comprising the step of selecting a component of said fluidic dielectric to include an industrial solvent.

41. The method according to claim 40 further comprising the step of selecting a component of said fluidic dielectric to include an industrial solvent that has a suspension of magnetic particles contained therein.

42. The method according to claim 41 further comprising the step of selecting a material for said magnetic particles from the group consisting of a ferrite, metallic salts, and organo-metallic particles.

43. The method according to claim 41 further comprising the step of selecting said component to include about 50% to 90% magnetic particles by weight.

44. The method according to claim 25 further comprising propagating said RF signal along a plurality of said filter elements.

45. The method according to claim 44 wherein a first one of said filter elements is at least partially coupled to said first fluidic dielectric and a second one of said filter elements is at least partially coupled to said second fluidic dielectric.

46. The method according to claim 45 wherein at least one of said permittivity and said permeability of said first fluidic dielectric is adjusted independently of a permittivity and a permeability of said second fluidic dielectric.

47. The method according to claim 46 wherein said adjustment of said permittivity and said permeability of said first dielectric changes an impedance of said first filter element.

48. A continuously variable filter, comprising:

a fluidic dielectric having a permittivity and a permeability;

a composition processor adapted for changing a composition of said fluidic dielectric to dynamically vary said permittivity and said permeability; and a filter element at least partially coupled to said fluidic dielectric.

* * * * *